US005092827A

United States Patent [19]

McAdam, III et al.

[11] Patent Number: 5,092,827

[45] Date of Patent: Mar. 3, 1992

[54] APPARATUS FOR FOLDING PAPER BOXES

[75] Inventors: Hugh A. McAdam, III, Wilton; Robert Tremblay, Hollis; James Pacocha, Hudson, all of N.H.

[73] Assignee: International Paper Box Machine Co., Inc., Nashua, N.H.

[21] Appl. No.: 413,790

[22] Filed: Sep. 28, 1989

[51] Int. Cl.[5] ..... B31B 5/26; B31B 3/58

[52] U.S. Cl. ..... 493/179; 493/423

[58] Field of Search ..... 493/178, 179, 423

[56] References Cited

U.S. PATENT DOCUMENTS

| | | | |
|---|---|---|---|
| 833,329 | 10/1906 | Low | 493/179 |
| 992,244 | 5/1911 | Potdevin | 493/179 |
| 1,536,800 | 5/1925 | La Bombard et al. | 493/179 |
| 2,931,277 | 4/1960 | La Bombard | 493/179 |
| 2,986,078 | 5/1961 | Hottendorf | 493/179 |
| 4,121,506 | 10/1978 | Van Grouw | 493/179 |
| 4,295,841 | 10/1981 | Ward | 493/179 |
| 4,319,878 | 3/1982 | Dozier et al. | 493/179 |
| 4,547,183 | 10/1985 | Mowry | 493/182 |
| 4,614,512 | 9/1986 | Capdeboscq | 493/179 |

*Primary Examiner*—William E. Terrell

*Attorney, Agent, or Firm*—Pearson & Pearson

[57] ABSTRACT

Apparatus and a method for folding flaps onto panels formed in folded box blanks, particularly those constructed from corrugated carboard. As a blank advances along a paper line, a first station engages leading edges of the flaps and forces the flaps into an intermediate plane representing a partial folding operation. Then a second station controls the relative velocities of the flaps along the paper line with respect to the panels to compensate for skew that can occur in other stations. A final station completes the folding operation. The resulting fold is made about an axis, or fold line. If the flap is to be folded about a prestamped score line, the fold and score lines are coextensive. Typically the flaps are folded 180° and the first station produces intermediate folds that are displaced 90° from the panels.

20 Claims, 5 Drawing Sheets

APPARATUS FOR FOLDING PAPER BOXES

BACKGROUND OF THE INVENTION

1. Field of the Invention

This invention is generally related to a method and apparatus for folding paper boxes and more specifically to a method and apparatus for folding a flap with respect to a panel during the manufacture of corrugated cardboard boxes.

2. Description of Related Art

During the manufacture of paper boxes, paper blanks advance along a paper line for diverse folding and gluing operations. The paper blanks comprise "score lines" that divide the blank into sections. During folding operations, the sections are folded about the score lines to produce the sides, top and bottom of a completed box. In one such folding and gluing operation, preglued edge flaps are folded into a partially overlapping relationship over central, adjoining panels of a blank along certain score lines. The blank is pressed to effect glued joints thereby to produce a completed structure in the form of a folded box.

Prior art apparatus for producing such folding boxes includes a conveyor that engages one or more central panels and advances blanks along a paper line seriatim. The paper line typically parallels those score lines that lie between the flaps and adjoining panels. These score lines define the sites of ensuing operations during which the flap is folded about an axis onto the adjacent panel. The objective of these folding operations is to fold the flaps about axes, called "fold lines", that are coextensive with the preexisting respective score lines.

As the blank advances along the paper line, it passes below one or more backing bars aligned with the preexisting score lines. A single, continuous folding belt system engages the leading edge of the flap and a contiguous area along the surface of the flap. Each belt system comprises a relatively wide belt that runs over a series of pulleys mounted in progressively rotated planes, so the plane of the belt turns from a 0°, or initial, plane to a 180°, or final, plane. As this occurs, the belt folds the flap onto the central panel. Initially the folding belt system coacts with the backing bar to begin the fold. However, the backing bar usually terminates at a point along the paper line intermediate the folding belt section. This allows the folding belt to force the flap against the panel and produces a sharp, oftentimes creased, corner.

Continuous folding belt systems work quite well with thin cardboard or boxes. However, operating problems can result when these folding belt systems are used to fold flaps onto panels of corrugated cardboard blanks. Apparently these problems arise from the construction of the corrugated cardboard itself. As known, corrugated cardboard blanks comprise paper formed into parallel ridges and grooves sandwiched between cardboard faces. Usually the exterior cardboard faces are finished paper, often with surface printing to appear on the outside of the box. As with other blanks, the corrugated paper blanks have a number of score lines that define the sites for various folding operations.

Score lines are located on a blank independently of the internal structure of the corrugated cardboard. It is therefore a characteristic of these blanks that these score lines that parallel the grooves and ridges of the corrugations are located without reference to the position of the grooves and ridges either on a single blank or with respect to successive blanks. A score line can be located at a ridge, a valley or any intermediate location. However, the position of the score line relative to the ridges and valleys determines, in part, the folding characteristics of the corrugated cardboard. If the score line positions vary within a blank and from blank to blank, then the folding characteristics also vary from blank to blank.

This inherent variation in folding characteristics manifests itself during both manual and automatic folding operations on corrugated cardboard boxes. After a blank is folded along a score line parallel to the grooves and ridges, the actual fold line may skew with respect to the score line. When the fold line skews, the flap does not register with the central panel. This is particularly evident in conventional paper box folding machines using single folding belt systems. It becomes difficult to compensate for the variations in the folding characteristics introduced by shifts in the position of the score line relative to the ridges and valleys, particularly on a blank-by-blank basis.

Moreover it is difficult to maintain the belt velocity of the folding belt system, both in speed and direction, constant relative to the speed and direction of the surface of the flap as it travels along the paper line. If relative motion occurs between the folding belt and the surface of the blank, surface scuffing can occur. As the folding belt system usually engages the exterior surface, any such scuffing can mar the finished surface of the carton or any printing on the carton. Any such marring produces an unusable box.

SUMMARY

Therefore it is an object of this invention to provide an apparatus and method for folding corrugated cardboard box blanks.

Another object of this invention is to provide an improved apparatus and method for folding a flap along a predetermined score line.

Still another object of this invention is to provide an improved apparatus and method for folding a flap along a predetermined score line in a corrugated cardboard blank.

Yet another object of this invention is to provide a apparatus and method that is useful in processing paper boxes seriatim.

Still yet another object of this invention is to provide an improved apparatus and method for folding flaps of paper box blanks along score lines in successive blanks.

Yet still another object of this invention is to provide a apparatus and method for folding a flap with respect to a paper box blank that minimizes the chances of scuffing or marring the surface of the blank.

In accordance with the apparatus and method of this invention, a paper box folding machine folds an end flap onto a central panel in three successive operations as the blank travels along a paper line. In a first operation the blank moves along a paper line and a belt system engages a flap. The entrance to this belt system is in the plane of the blank and the exit is at a plane through the fold line but angularly displaced with respect to the blank. In accordance with another aspect of this invention the first fold is produced by the first belt system including a round belt that extends in a linear path from the entrance to the exit. Moreover the entrance and exit lie equidistant from the fold line. In a second operation another, independent belt system engages the partially folded flap and advances it relative to the central portion without any further folding motion. In a final operation a folding belt system engages the blank and completes the fold about the fold line.

BRIEF DESCRIPTION OF THE DRAWINGS

This invention is pointed out with particularity in the appended claims. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
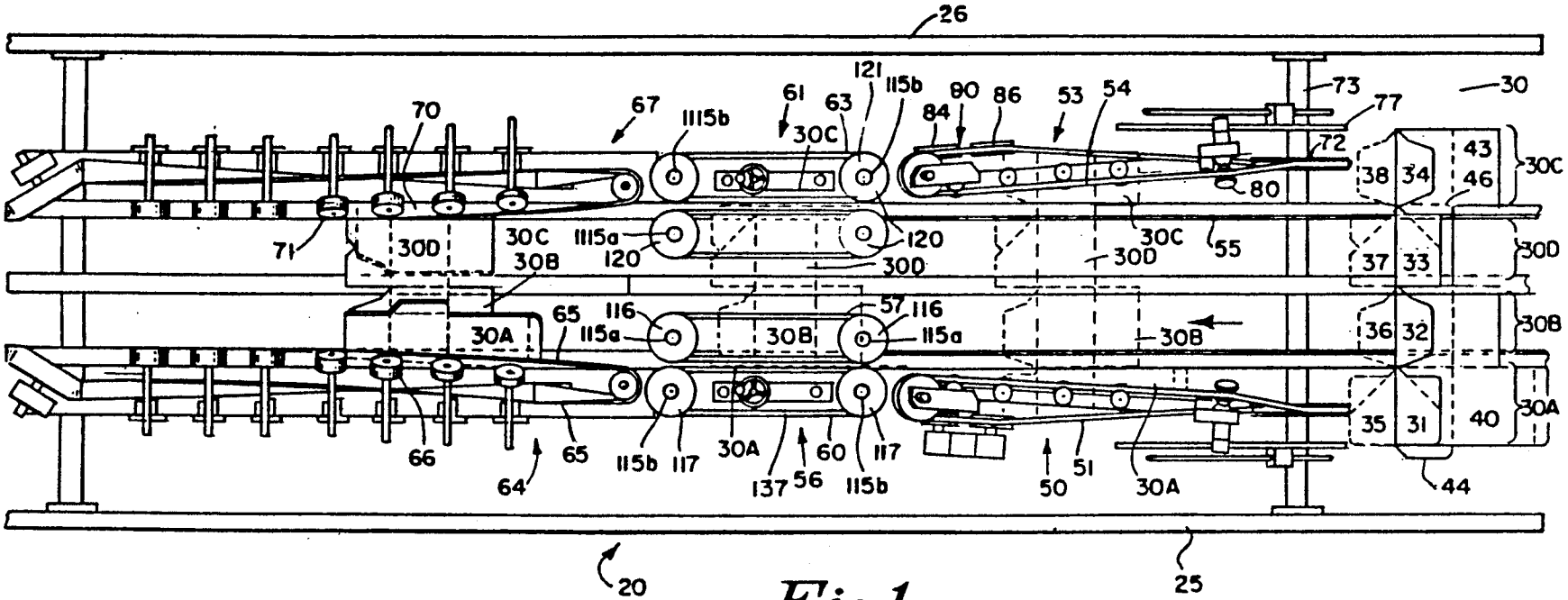
FIG. 1 is a top plan view of an apparatus embodying various features of the invention that depicts a first folding station, an intermediate advancing station and a second folding station.
Figure 2:
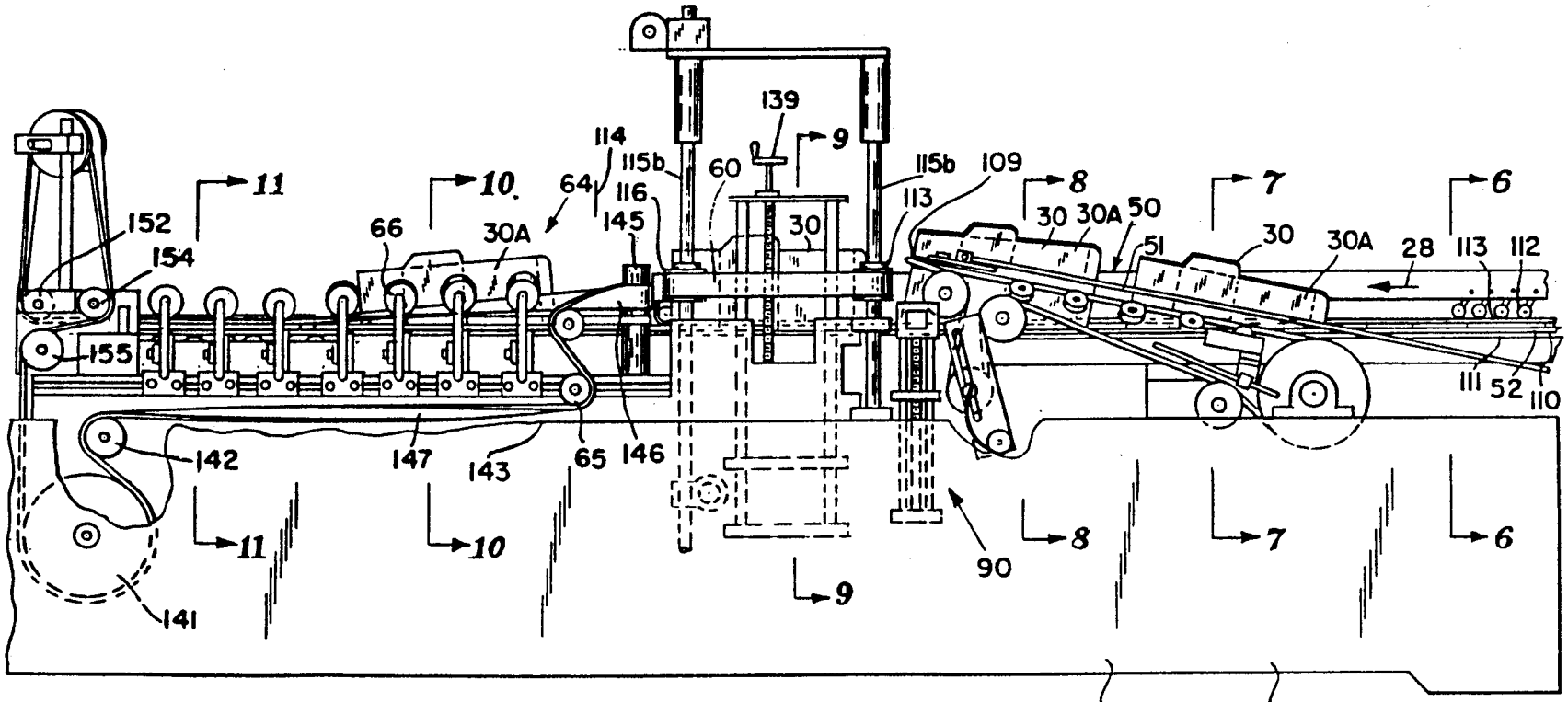
FIG. 2 is a side plan view of the apparatus shown in FIG. 1.

As shown in FIGS. 1 and 2, a paper box folding machine 20 constructed in accordance with this invention comprises three stations disposed along a paper line from a receiving station 21. These three stations include a first folding station 22, an advancing station 23 and a second folding station 24. Side frames 25 and 26 support the apparatus that comprises these stations. A common drive unit, represented by 27 in FIG. 3, powers each of the stations. Arrows 28 designate the paper line that generally extends from right to left in FIGS. 1 and 2.

The apparatus shown in FIGS. 1 and 2 acts on precut and prestamped blanks for producing folded cartons which travel individually and successively along an elongated horizontal path. One such blank 30 is shown in FIG. 1. It contains four rectangular side panels 31, 32, 33 and 34. Four bottom panels 35, 36, 37 and 38 extend from the four rectangular sides 31 through 34 respectively. A top or cover section 40 with a insert flap 41 extends from the side 31 while side flaps 42 and 43 extend from sides 32 and 34 respectively. An overlapping glue tab 44 extends from the outer edge of the side 31. Score lines 45 and 46 represent a number of score lines that separate the various panels and flaps and establish fold lines. These particular score lines are parallel to the grooves of a corrugated cardboard blank 30.

Initially, each blank is planar with the bottom panels 35 through 38 extending from the sides 31 through 34. This outline is represented by the dashed line position of the panels 35 through 38. In a typical operation, plows, guides and related elements of the receiving station fold the bottom panels 35 through 38 around other score lines back over the sides 31 through 34, so the blank 30 appears as shown by the solid lines when it reaches the first folding station 22. Glue applicators typically apply glue to the bottom flaps 35 and 37 and to the outer edge portion of the side 34 in the receiving section 21.

It is the purpose of the specific embodiment of the folding apparatus of this invention, including the stations 21, 22 and 23, to fold two portions of the blank 30 into an overlapping relationship with other portions. In this embodiment a first portion is a flap 30A comprises the bottom panel 35, side 31, glue tab 44, cover 40 and insert tab 41. This flap 30A will be folded along the score line 45 over a central panel 30A comprising the bottom panel 36, the side 32 and the side flap 42. Similarly, the apparatus shown in FIG. 1 can simultaneously fold a flap 30C onto a panel 30D along a score line 46. The flap 30C includes the bottom panel 38, the side 34 and the side cover 43. The panel 30D includes the bottom panel 37 and the side 39. Further, the apparatus folds overlaps the outer edge of flap 30C with respect to the glue tab 44.

In accordance with one aspect of this invention, the apparatus 20 uses three discrete steps, rather than in a single operation, to fold the flaps 30A and 30C. As the blank 30 passes through the first folding station 22, apparatus folds the flaps 30A and 30C to intermediate planes that intersect the respective score lines 45 and 46. Typically this intermediate plane is displaced 90° from the initial plane of the blank 30. In such apparatus, the first folding station 22 folds the flaps 90° with respect to the panels 30B and 30D.

In the flap advancing station 23, other apparatus engages the flaps 30A and 30C as they exit the first folding station 22. This apparatus moves the flaps 30A and 30B relative to the panels 30B and 30D, respectively. Specifically, the blank 30 moves along the paper line in the direction of the arrow 28 at a given speed or velocity. The apparatus engaging the respective flaps 30A and 30C independently control the velocities at which the flaps 30A and 30C advance parallel to the paper line 28 with respect to the panels 30B and 30D. This apparatus compensates any skew introduced in the first folding station 22 and that may be introduced in the final folding station 24 thereby to properly align the panel and flap.

In the final folding station 24 a folding belt system engages the partially folded flaps 30A and 30C as they exit the flap advancing station 23. The folding belt system folds the flaps 30A and 30C to a final position, typically onto the center panels 30B and 30D. Normally this system times the folding operations for each flap so an edge of the flap 30C overlies the glue tab 44 on the flap 30A.

Thus, in a typical operation the first folding station 22 folds the flaps 30A and 30C 90° about the score lines 45 and 46. Then the flap advancing station 23 realigns the relative positions of the flaps 30A and 30C with respect to the panels 30B and 30D before the second folding station 24 folds flaps 30A and 30C another 90°. The use of these three discrete steps produces fold lines that are coextensive with the score lines 45 and 46. As a result, it is much easier to maintain registration between the flaps and panels through the folding operation. This simplifies operations, reduces the number of defective boxes and increases throughput for the folding box apparatus.

General Equipment Construction

Referring to FIGS. 1 through 4, the first folding station 22 comprises a belt mechanism 50 including a belt 51 with a circular cross section that cooperates with a backing bar 52 to fold the flap 30A. The backing bar 52 is coextensive with the first folding station 22 and the flap advancing station 23 and a portion of the second folding station 24. An independently operable belt mechanism 53 includes a circular belt 54 and cooperates with a backing bar 55 to fold the flap 30C. Mechanisms known in the art align the outer edges of the backing bars 52 and 55 over the score lines 45 and 46. The backing bars 52 and 55 support the panels 30B and 30D as the belt mechanisms 50 and 53 fold the flaps 30A and 30C respectively.

Figure 3:
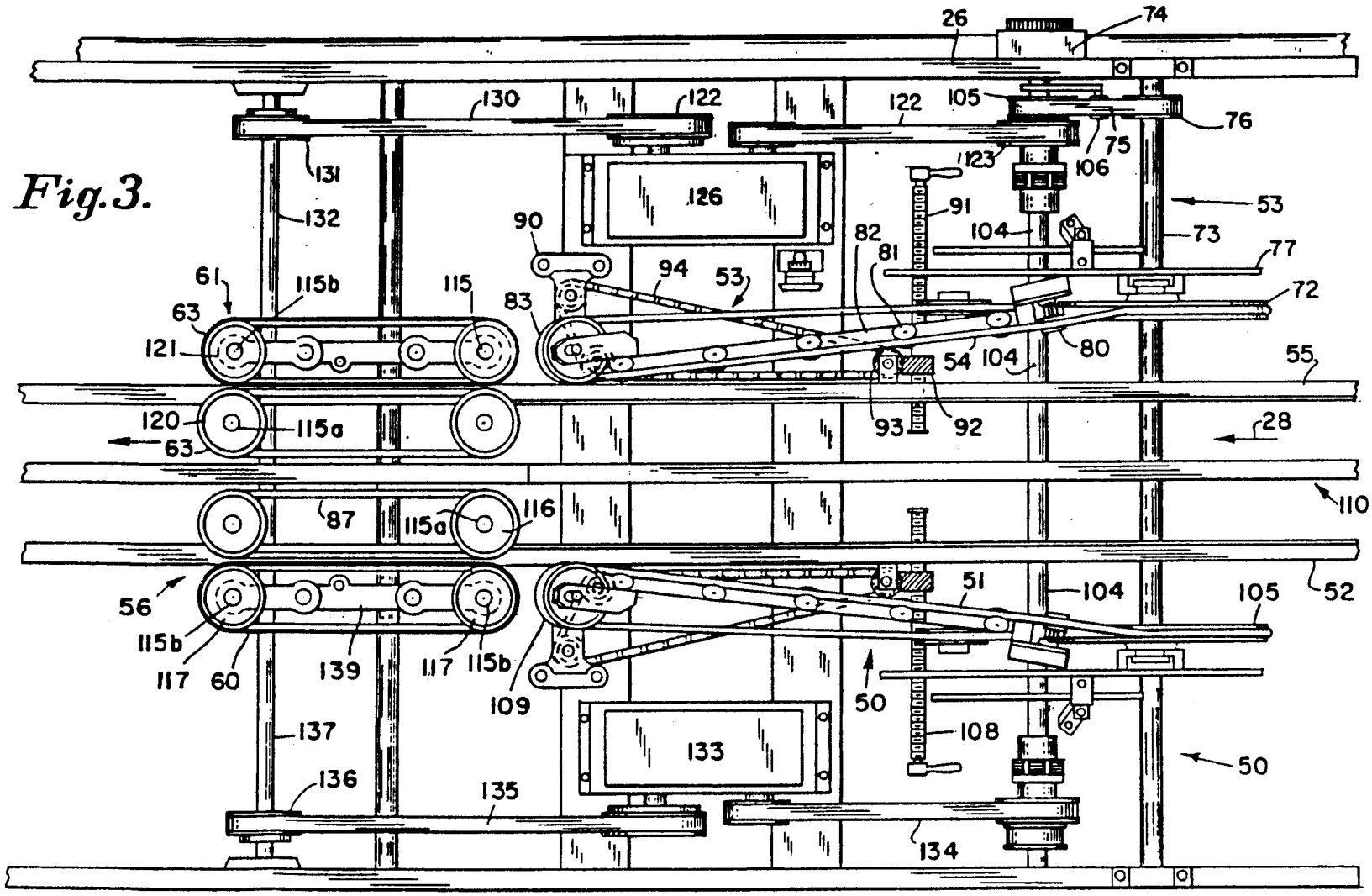
FIG. 3 is a top plan view showing, in greater detail, the first folding and advancing stations of the apparatus shown in FIG. 1.

After the belt mechanisms 50 and 53 fold the flaps to a first intermediate plane (i.e., normally 90°) the blanks 30 pass into the flap advancing station 23 as shown in FIGS. 1 through 3. An independently driven belt mechanism 56 including an inner belt 57 and outer belt 60 engages both sides of the prefolded flap 30A thereby to control the advance of the flap 30A along the paper line 28. Similarly, an independently driven belt mechanism 61 including an inner belt 62 and an outer belt 63 engages opposite sides of the upstanding flap 30C to control its advance along the paper line 28. As will be apparent, if the independently driven belt mechanisms 56 and 61 positively engage the flaps 30A and 30C respectively, it is possible either to slow or increase the velocity of a flap with respect to the velocity of the attached panel along the paper line 28. Typically the independent belt mechanisms 56 and 61 tend to overdrive or accelerate the flaps 30A and 30C with respect to the panels 30B and 30D respectively.

A folding belt mechanism 64 in the final folding station 24 includes a continuous belt 65 and directing pulleys 66. The belt 65 engages the flap 30A as it exits the flap advancing station 23 and folds it onto the panel 30B as the blank 30 progresses along the paper line 28. A folding belt mechanism 67 including a continuous belt 70 and directing pulleys 71 performs a similar folding function on the flap 30C. As described later, the directing pulleys 66 and 71 are oriented relative to each other so an edge of the flap 30C overlies the glue tab 44 on the flap 30A.

With this basic understanding of the operation of the system shown in FIGS. 1 and 2 it is now possible to understand the detailed construction of each of the folding and flap advancing sections.

First Folding Station 22

Figures 4, 5:
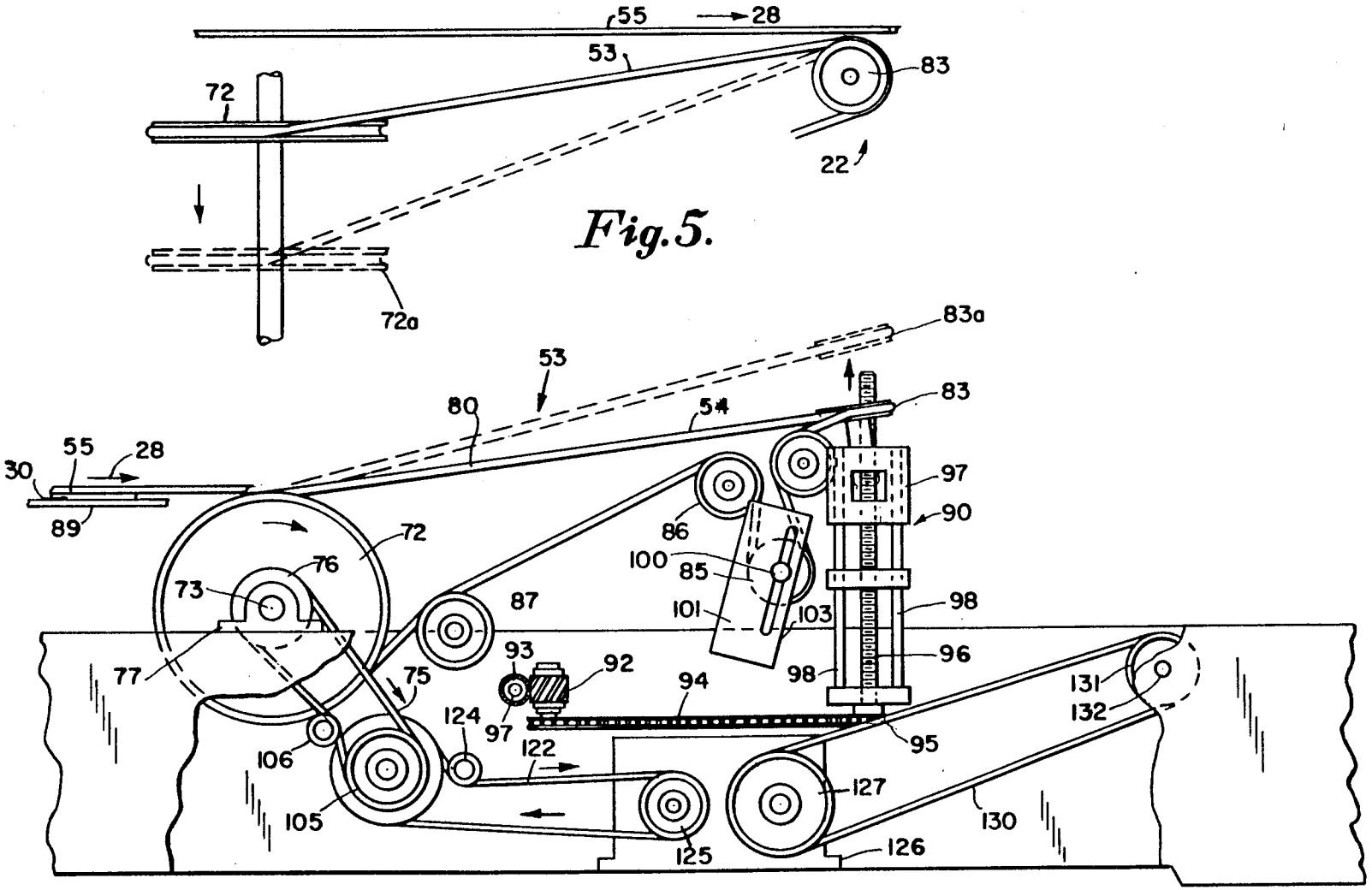
FIG. 4 is a detailed view showing the apparatus in operation of the first folding station shown in FIGS. 1 through 3.
FIG. 5 is a partial plan view of the apparatus shown in FIG. 4.

Referring to FIGS. 1, 3 and 4, the belt mechanism 53 comprises a drive pulley 72 mounted on a drive shaft 73 coupled to a drive power takeoff 74 (shown in FIG. 3) and the drive unit 27 as described later by a belt 75 that drives a pulley 76 mounted on the drive shaft 73. A frame member, represented by reference numeral 77, supports the belt mechanism 53 and can slide along the drive shaft 73.

Still referring to FIGS. 1, 3 and 4, an idler pulley 80 directs the circular belt 54 as it exits from the pulley 72 toward a line of idler pulleys 81. A frame 82 supports the belt 54 in a straight line between an entrance and exit for a flap. The pulley 72 defines the entrance; the turning pulley 83, the exit. As shown in FIG. 4, the belt 53 returns from the exit over another idler pulley 84, a tensioning pulley 85, and idler pulleys 86 and 87.

The circular belt 54 engages a leading edge of the flap 30C, formed by the transverse fold of the bottom panel 38 over the side 34 and forces the flap 30C through a 90° fold. As specifically shown in FIGS. 4 and 5, the turning pulley 83 is located vertically above the backing bar 55 and above the exit plane of the belt 53 from the pulley 72. Thus, the belt 53 rises as a blank moves along the paper line (from left to right in FIGS. 4 and 5) with respect to the backing bar 55. The pulley 72 is displaced horizontally from the backing bar 55 and the vertical plane through the backing bar 55. This causes the belt 53 to advance toward the center of the paper line 28 as it moves along the paper line 28. Thus, the pulley 72 positions the belt 53 to define an entrance point at which a blank enters the first folding station 22. That entrance point is in the plane of the blank and displaced some distance from the backing bar 55. Likewise, the pulley 83 positions the belt 53 to define an exit point at which a blank leaves the first folding station 22. That exit point is in a plane through the outer edge of the backing bar 55 and the score line 46. This plane represents an intermediate folding plane. Typically the intermediate folding plane will be displaced 90° to the initial plane of a blank 30. In addition, the exit and entrance points are equidistant from the score line.

Figure 6:
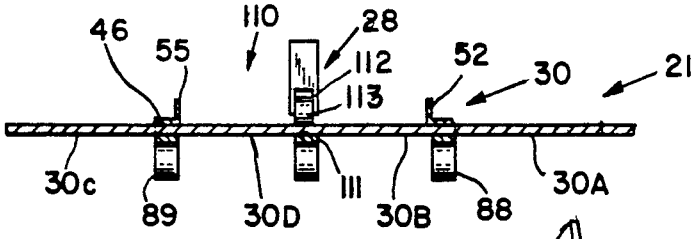
FIG. 6 is a cross-sectional view taken along lines 6—6 in FIG. 2.
Figure 7:
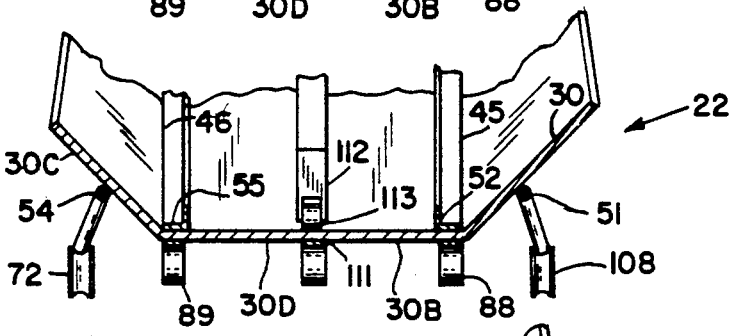
FIG. 7 is a cross sectional view taken along lines 7—7 in FIG. 2.
Figure 8:
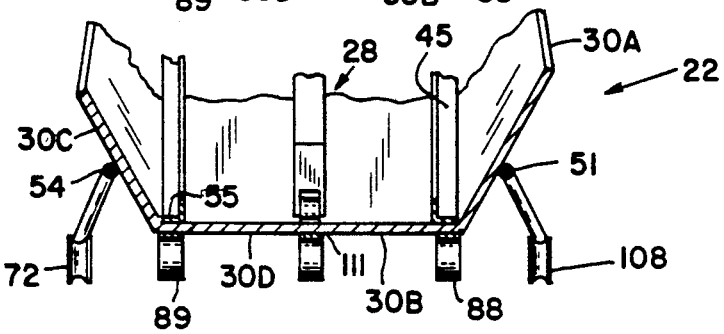
FIG. 8 is a cross sectional view taken along lines 8—8 in FIG. 2.

The operation of these mechanisms can be understood by referring to FIGS. 6, 7, and 8 that show an edge of the blank as it advances along the paper line 28 from the receiving station 21 (FIG. 6) through the first folding station (FIGS. 7 and 8). As shown in FIG. 6, as a blank 30 advances along the paper line in the receiving station 2!, the backing bars 52 and 55 overlie the panels 30B and 30C adjacent the score line 45 and 46 respectively. The panels 30B and 30D of a blank 30 are thereby confined loosely between the backing bars 52 and 55 and conveyors 88 and 89 respectively Such structures are known in the art.

As a blank 30 enters the first folding station 22 in FIGS. 7 and 8, the belt 51 engages the edge of the flap 30A at some distance from the fold line 45, as shown in FIG. 7. As the blank advances down the paper line 28, the position of the belt 51 with respect to the backing bar 52 moves up and to the left, as shown in FIGS. 7 and 8, thereby increasing the amount the flap 30A folds about the score line 45. A similar operation occurs on the other side of the paper line 28 as the belt 54 engages the flap 30C such that the contact point between the belt 54 and the flap 30C moves progressively up and to the right as shown in FIGS. 7 and 8 with respect to the backing bar 55, thereby to fold the flap 30C about the score line 46. During these operations the backing bars 52 and 55 and the conveyors 88 and 89 support the panels 30B and 30C so they remain in their original horizontal planes.

This folding operation can be optimized for a particular blank by controlling the position at which the belts 51 and 54 engage the leading edges of the flaps 30A and 30C. However, it also is necessary to maintain the equidistant displacements of the entrance and exit points with respect to the score lines. A height adjusting mechanism moves the pulley 83 vertically, for example to a position 83A shown in phantom in FIG. 4. During this motion, the belt 53 remains tangent to the vertical plane through the outer edge of the backing bar 55 (i.e., the score line 46) as shown in FIG. 5. The height adjustment occurs simultaneously with any horizontal adjustment of the pulley 72 to a position such as position 72a shown in FIG. 5. During horizontal adjustment, the belt 54 at its exit from the pulley 72 remains in the plane of the blank (i.e., the horizontal plane established by the backing bars 52 and 55). Moreover, the entrance and exit points are always equidistant from the score lines. That is, if the pulley 72 is two inches from the backing bar 55, the pulley 83 is two inches above from the bottom surface of the backing bar 55. If the pulley 72*a* shown in FIG. 5 is twelve inches from the backing bar 55, the pulley 83 moves to the position 83*a*, shown in phantom in FIG. 4, that is twelve inches above the bottom surface of the backing bar 55.

FIGS. 3 and 4 depict the adjustment means. A manual crank handle and adjusting screw 91 rotates in the supporting structure to the backing bar 55 so that the belt mechanism moves with the backing bar 55. Rotating the screw 91 adjusts the position of the frame 77 and hence the pulley 72. The screw 91 also drives a right angle gear assembly 92 with an output sprocket 93 that drives a chain 94 that engages a sprocket 95 at one end of a vertical adjusting screw 96. The screw 96 threads into a carriage 97 that slides on parallel, spaced vertical shafts 98.

If the pitches on the adjusting screws 91 and 96 are the same, the gear ratios are selected so each revolution of the crank 91 produces a single revolution of the adjusting shaft 96. Thus, the pulley 72 and pulley 83 move equidistantly in the horizontal and vertical directions respectively.

Referring to FIG. 4, the distance between the pulley 72 and the pulley 83 varies during these adjustments, so the path length for the belt 54 around the pulleys varies. A tensioning device maintains constant belt tension. More specifically, a shaft 100 supports the tension pulley 85 and rides in a slotted frame 101 that pivots on a shaft 102. A spring 103 between the shafts 100 and 102 forces the shaft 100 toward the shaft 102 and maintains appropriate tension on the belt 53.

As previously indicated, the belt 75 that drives the belt mechanism 55 is coupled to the main drive 27 for the entire system. Referring to FIGS. 3 and 4, one coupling mechanism includes an output shaft 104 from the power takeoff 74 with a drive pulley 105. The belt 75 runs around this pulley 105, the pulley 76 on the shaft 73 and an idler pulley 106.

As shown primarily in FIG. 3, the belt mechanism 50 is essentially identical to belt mechanism 53. The drive shaft 73 connects to drive pulley 72 in the belt mechanism 53 and a corresponding pulley 107 in the mechanism 50. Thus, the belts 54 and 51 run at equal velocities. However, the entrance and exit points are adjustable. Specifically, as shown in FIG. 3, an adjusting mechanism screw 108 positions the pulley 107 and a pulley 109 associated with the belt mechanism 50.

In operation, initial adjustments are made to position the backing bars 52 and 55 and the pulleys 71 and 107 with respect to the score lines 46 and 46. Referring to FIG. 6, a main conveyor assembly 110 engages the control region of a blank to advance the blank along the paper line 28.

Referring to FIGS. 1 through 4, the main drive shaft 104, that receives its input from the power takeoff 73 shown in FIG. 3 drives the belt mechanisms 56 and 61 in the station 23. The main conveyor assembly 110 connects to the drive unit 27 as known in the art. For purposes of an understanding of this invention, the main conveyor assembly 110 includes a conveyor belt 111 that is driven by the main drive 27. The conveyor moves in the direction of the paper line as indicated by the arrow 28. As a blank 30 moves along on top of the conveyor belt 111, it is sandwiched and held against the conveyor by a hold-down mechanism including upper rollers 112 and an upper belt 113. The upper belt 113 may be driven at the same speed as the belt 111 or may also be organized to merely be carried through friction between the blank and the upper conveyor belt 113. The main conveyor belt 111 extends through and beyond the receiving station 21, the first folding station 22, the flap advancing station 23 and the final folding station 24 thereby to control the transfer and movement of a blank along the paper line 28. The upper belt may terminate at a position represented by reference numeral 114 in FIGS. 1 through 3 between the flap advancing station 23 and final folding station 24.

As a blank advances into the first folding section 22, shown in FIG. 7, the belts 51 and 54 engage the leading edges of the flaps 30A and 30C. As shown in FIGS. 7 and 8, the belts 51 and 54 maintain a constant displacement from the respective score lines 45 and 46. In this specific embodiment the belts 51 and 54 produce a 90° fold about the score lines 45 and 46.

The flaps 30A and 30C, when constructed of corrugated cardboard, tend to remain reasonably stiff. As a result, the belts 51 and 54, with their circular cross sections, engage the blank only at the leading edge represented by the transverse fold lines where the bottom panels 35 and 38 fold back over the side panels 31 and 34 respectively. There is no substantial contact or force exerted between the belts 51 and 54 and the surfaces of the panels 30A and 30C respectively. Thus, if any relative motion should occur between the belts and the flaps, it occurs only at a point contact so scuffing and surface marring are avoided as there is no contact between the belts 51 and 54 and the surfaces of the flaps.

Flap Advancing Station 23

As previously indicated, a flap tends to lag behind its adjoined panel as a blank moves through the first folding station 22. With a 90° bend, the upright edges of the flaps tend to move backward from the perpendicular. This manifests itself by a tendency of the fold line to roll away from or skew with respect to the score line.

The flap advancing station 23 shown in FIGS. 1 through 3 compensates this tendency. The independent belt mechanisms 56 and 61 engage the flaps 30A and 30C respectively as they emerge from the first flap folding station 22. The linear velocities of the belt mechanisms, however, are adjustable with respect to the speed of the main conveyor 110 and each other.

The independent belt mechanism 56 that engages the flap of 30A comprises a series of four upstanding shafts. Inner shafts 115*a* or carry pulleys 116; outer shafts 115*b*, pulleys 117. The inner belt 57 rotates about the pulleys 116 while the outer belt 60 rotates about pulleys 117. Likewise, the independent driven belt mechanism 61 that engages flap 30C also comprises inner shafts 115*a* that support pulleys 120 and outer shafts 115*b* that support pulleys 121. The belt 62 rotates about the pulleys 120 and the belt 63 rotates about the pulleys 121.

Referring to the independent belt mechanism 61 as shown in FIGS. 3 and 4, the drive shaft 104 drives a belt 122 by means of a pulley 123. The belt 122 runs over an idler pulley 124 and rotates an input shaft 125 of a variable speed drive 126. An output shaft and pulley 127 drive a belt 130 thereby to rotate a pulley 131 and a shaft 132. The drive shaft 104 also provides input into a second variable drive 133 associated with the independent belt mechanism 56. A belt 134 couples the drive shaft 104 to the input of the variable speed drive 133. Another belt 135 couples the output shaft of the variable drive 133 to a pulley 136 and drive shaft 137. The drive shafts 132 and 137 are therefore independently variable with respect to speed.

As shown in FIG. 2, the drive shaft 137 couples through a right-angle drive 140 to rotate one of the outer shafts 115*b* associated with pulley 117 and belt 60. A similar right-angle drive connected to the shaft 132 engages the shaft 115*b* associated with pulley 121 and belt 63.

Figure 9:
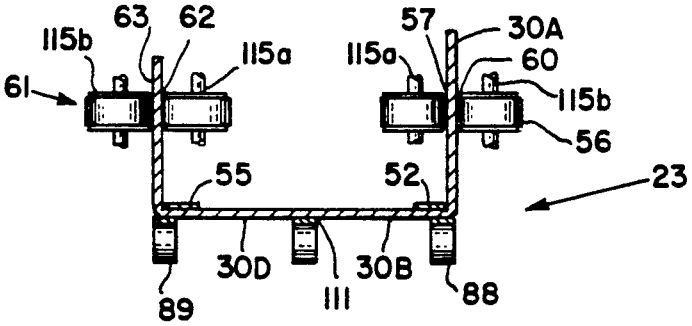
FIG. 9 is a cross sectional view taken along lines 9—9 in FIG. 2.

The variable speed drives 126 and 133 enable independent control of velocities of the belts 63 and 60, respectively with respect to the velocity of the conveyor 110. Typically the velocity of the belts 60 and 63 exceed the velocity of the conveyor 110. Thus, as the independently driven belt mechanisms 56 and 61 engage the flaps 30A and 30C as shown in FIG. 9, they tend to advance the flaps faster than the conveyor 110 advances the panels 30B and 30D. This skews the flaps "forward", that is, in the opposite direction from any skewing that occurs in the initial folding station 22.

Although a number of belt structures have been utilized, FIGS. 3 and 9 indicates two different approaches. In one, the belts 57 and 60 are composed of the same urethane based material, such as Texthane. The belts are generally ribbed transversely to improve the grip with the cardboard of the blank flaps 30A and 30C. In another approach, the surface of one belt, such as the belt 63 in FIG. 3, has a waffle surface. Waffle surfaces can provide better gripping while minimizing any tendency to scuff or mar the surface of a blank.

Final Folding Station 24

As a blank emerges from the flap advancing station 23, it passes into the final folding station 24 that uses a conventional folding belt assembly to complete the fold. A flywheel 141 on a shaft coupled to the main drive unit shown in FIG. 2 drives the belt 65. Specifically, the belt 65 runs over the flywheel 141, idler pulleys 142, 143 and 144, a turning shaft 145 that produces a 90° bend at the location designated by reference numeral 146 thereby to move the belt 65 into a vertical orientation to receive the flap 30A. The idlers 66 are positioned to progressively rotate the belt 65 into a horizontal position through a plurality of adjustable roller supports such as shown at 147. When the folding operation is completed, the belt 65 shown in FIG. 3 returns to the flywheel 141 through an idler 152, a skewed idler 153 that provides a lateral offset to the belt, and idlers 154 and 155. The idler 152 can move linearly to adjust belt tension. A belt system including belt 70 performs a similar function on the other side of the apparatus for engaging the flap 30C.

Figure 10:
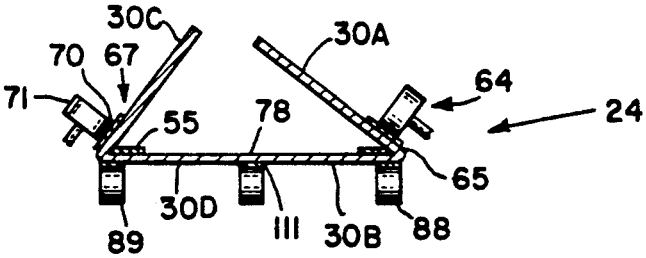
FIG. 10 is a cross sectional view taken along lines 10—10 in FIG. 2.
Figure 11:
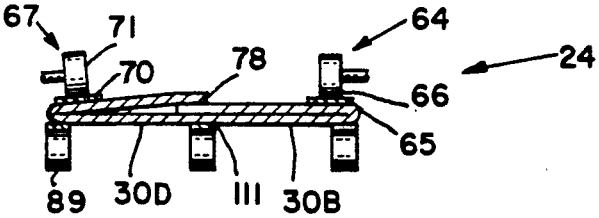
FIG. 11 is a cross sectional view taken along lines 11—11 in FIG. 2.

Referring to FIGS. 10 and 11 the blank 30 moves with the conveyor 111 and side conveyors 88 and 89 that are directly under the belts 65 and 70. Initially the backing bars 52 and 55 form guides against which the initial folding operation occurs. Those guides terminate, however, where the belts 65 and 70 reach a substantially horizontal location so the belts 65 and 70 can produce a clean, sharp corner.

Operation

In preparing for a production run of corrugated cardboard boxes, the receiving station 21 in FIGS. 1 and 2 will be adjusted to properly align blanks 30 with respect to the center line of the machine established along the center line of the conveyor 110. Further adjustments align outer edges of the backing bars 52 and 55 and associated mechanisms with their respective score lines 45 and 46. Next the belt mechanisms 50 and 53 are adjusted by means of the cranks 91 and 107 shown in FIG. 3 to properly orient independently the round belts 51 and 54 to an appropriate displacement from the score lines. As previously indicated this adjustment also sets the vertical heights of the pulley 83 and the corresponding pulley 109 shown in FIGS. 1 through 3.

The round belts 51 and 54 engage the leading edge of each blank 30 to begin the folding operation. As the blanks advance through the first folding station 22, the belts 51 and 54 maintain the flaps in planes that are angularly displaced with respect to the plane of the flaps 30A and 30C. Thus, the belts 51 and 53 engage only the leading edges of the flaps.

As the blanks continue to advance, adjustments are made to the variable speed drives 126 and 133 shown in FIG. 3 thereby to establish the relative speeds of the independently driven belt mechanisms 56 and 61 in the flap advancing station 23. This compensates for the skew introduced in both the initial and final folding stations 22 and 24. No additional folding occurs in the flap advancing station 23. The adjusting system 139 typically positions the belts 57, 60, 62 and 63 approximately at the height of the pulleys 109 and 83 respectively.

Finally the blanks emerge and pass into the final folding station 24 where conventional folding belt systems engage the edges of the blanks 30 to complete the fold as shown in FIGS. 10 and 11. As previously indicated, the incremental rotation of the belts 65 and 70 shown in FIG. 1 can be different so that the belt 65 folds tab 30A to its horizontal position in this machine prior to the belt 70 folding the tab 30C to a horizontal position whereby the flap 30C overlies the flap 30A.

It has been found that with this construction and operation involving successive, discrete folding, flap advancing and subsequent folding operations produce fold lines in corrugated cardboard boxes that correspond to the preexisting score lines. The flaps 30A and 30C remain in register with the panels 30B and 30D. Moreover, the folding occurs with a minimum tendency for any relative motion between the belts and the cartons, so marring and scuffing are kept at a minimum.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. In a paper box folding machine, apparatus for folding a flap onto a panel of each of a plurality of box blanks advancing individually and successively, at a predetermined velocity, along an elongated horizontal path defining a paper line, said apparatus comprising:

A. first station means for bending the flap on a blank about an axis extending in the direction of the paper line from the plane of the panel to an intermediate plane angularly displaced with respect to the panel, B. second station means receiving the blank from said first station means for independently controlling the relative velocity of the flap along the paper line in the intermediate plane with respect to the velocity of the panel thereby to align the flap and the panel transversely to the paper line, and C. third station means receiving the blank from said second station means for bending the flap beyond the intermediate plane onto the panel thereby to complete the the folding operation.

2. Paper box folding apparatus as recited in claim 1 wherein said first station means comprises:

i. a endless belt having a portion between an entrance point and an exit point therefor, ii. first positioning means for positioning said entrance point in the plane of the blank to engage the flap at a preselected location thereon, iii. second positioning means for positioning said exit point at the preselected location on the flap in the angularly displaced plane, and iv. belt drive means for driving said endless belt from said entrance point to said exit point whereby said endless belt folds the flap into the angularly displaced plane as the blank advances along the paper line.

3. Paper box folding apparatus as recited in claim 2 wherein said first folding station means additionally comprises adjustment means for interconnecting said first and second positioning means whereby operation of said adjustment means positions said first and second positioning means simultaneously.

4. Paper box folding apparatus as recited in claim 3 wherein said apparatus advances the panel through said first folding station means in a horizontal plane and the angular displacement between the first panel and flap is 90°, said adjustment means causing said first and second positioning means to move said entrance and exit points horizontally and vertically, respectively.

5. Paper box folding apparatus as recited in claim 4 wherein the blank has prescored lines formed therein that define the line along which a fold is occur, said paper line apparatus means including backing means for overlying a portion of each panel adjacent the prescored lines thereby to support the blank in the first, second and third folding station means.

6. Paper box folding apparatus as recited in claim 5 wherein said adjustment means in said first folding station means moves said entrance and exit points equal distances such that they remain equidistant from the prescored lines in the blank in their respective planes.

7. Paper box folding apparatus as recited in claim 5 wherein belt drive means comprises idler pulley means between said entrance and exit points for defining a linear path for said belt therebetween.

8. Paper box folding apparatus as recited in claim 7 wherein each of said first and second positioning means comprises pulley means for guiding said belt and means for supporting said pulley means at said entrance and exit points, respectively.

9. Paper box folding apparatus as recited in claim 7 wherein said belt drive means additionally comprises idler pulley means for directing said belt and tension means for maintaining operating tension on said belt.

10. Paper box folding apparatus as recited in claim 7 wherein said belt has a circular cross section.

11. Paper box folding apparatus as recited in claim 8 wherein said driving means comprises means for establishing the speed of said belt with respect to the speed at which the blank advances along the paper line past said first folding station means.

12. Paper box folding apparatus as recited in claim 2 wherein said second station means comprises:

i. adjustable velocity drive means coupled to said apparatus for establishing an output shaft velocity, ii. first and second juxtaposed belt means for gripping a flap therebetween, and iii. means for coupling said adjustable drive means to one of said belt means thereby to drive said belt means at a velocity determined by said adjustable velocity drive means.

13. Paper box folding apparatus as recited in claim 12 wherein said second station means additionally comprises means for positioning said belt means.

14. Paper box folding apparatus as recited in claim 12 wherein said belt means comprise first and second belts and first and second pulley pairs for supporting said first and second belt means respectively.

15. Paper box folding apparatus as recited in claim 14 wherein said first and second belts have diverse surfaces for engaging a blank.

16. Paper box folding apparatus as recited in claim 14 wherein said first belt has a waffle surface and said second belt has a transversely ribbed surface for engaging opposite sides of a flap.

17. Paper box folding apparatus as recited in claim 12 wherein said third station means comprises a folding belt system with an entrance oriented to the plane of a flap as the flap exits said second station means and an exit oriented to a plane that parallels the plane of a panel.

18. Paper box folding apparatus as recited in claim 17 wherein the blank has prescored lines formed therein that define the line along which a fold is to occur, said apparatus additionally comprising backing bar means for overlying a panel adjacent a prescored line and extending along the paper line to a position in said third station means, said folding belt system initially producing a fold about portions of said backing bar means that are coextensive with said first station means.

19. Paper box folding apparatus as recited in claim 2 wherein said third station means comprises a folding belt system with an entrance oriented to the plane of a flap as the flap exits said second station means and an exit oriented to a plane that parallels the plane of a panel.

20. Paper box folding apparatus as recited in claim 19 wherein the blank has prescored lines formed therein that define the line along which a fold is to occur, said apparatus additionally comprising backing bar means for overlying a panel adjacent a prescored line and extending along the paper line to a position in said third station means, said folding belt system initially producing a fold about portions of said backing bar means that are coextensive with said first station means.

* * * * *